US005599198A

United States Patent [19]

Wang

[11] Patent Number: 5,599,198

[45] Date of Patent: Feb. 4, 1997

[54] AUTO BY-PASS DISTRIBUTOR FOR COMPUTER NETWORKS

[76] Inventor: Tsan-Chi Wang, 1Fl., No. 13, Lane 312, Chung Chen Rd., Hsin Tien City, Taipei Hsien, Taiwan

[21] Appl. No.: 402,530

[22] Filed: Mar. 10, 1995

[51] Int. Cl.[6] ..... H01R 13/703

[52] U.S. Cl. ..... 439/188; 439/944

[58] Field of Search ..... 439/188, 944; 200/51.1, 51.04, 51.09

[56] References Cited

U.S. PATENT DOCUMENTS

| | | | |
|---|---|---|---|
| 5,090,915 | 2/1992 | Moulton | 439/188 |
| 5,219,297 | 6/1993 | Stein et al. | 439/188 |
| 5,503,566 | 4/1996 | Wang | 439/188 |

*Primary Examiner*—Neil Abrams
*Attorney, Agent, or Firm*—Bacon & Thomas

[57] ABSTRACT

An auto by-pass distributor for distributing computer network signals to personal computers includes a first signal terminal (10) of a first coaxial cable connector, a second signal terminal (20) of a second coaxial cable connector, a first metal contact plate (11) disposed in contact with the first signal terminal (10), a second metal contact plate (21) disposed in contact with the second signal terminal (20), a first conductor (32) connected between the first signal terminal (10) and the second metal contact plate (21), and a second conductor (31) connected between the second signal terminal (20) and the first metal contact plate (11). When one or both of the first and second coaxial cable connectors is disconnected from or not properly connected to a personal computer, the respective first or second signal terminal engages the contact plate to establish a shunt circuit between the signal terminals and thereby maintain a network series connection.

1 Claim, 4 Drawing Sheets

AUTO BY-PASS DISTRIBUTOR FOR COMPUTER NETWORKS

BACKGROUND OF THE INVENTION

The present invention relates to electric coupling devices for computers, and relates more particularly to a distributor for computer networks which has the function of auto by-pass.

Various coupling devices have been disclosed for use in distributing computer network signals to personal computers. Examples of these devices are shown in U.S. Pat. No. 4,437,722 issued to Biarchi; U.S. Pat. No. 4,588,249 issued to Blichasz et. al.; U.S. Pat. No. 4,687,446 issued to Birch et. al.; U.S. Pat. No. 4,850,895 issued to Arai et. al.; U.S. Pat. No. 5,076,799 issued to Virgo. The patent entitled "Computer Network Distribution System" U.S. Pat. No. 5,503,566, issued to Tsan-Chi Wang, filed on Oct. 5, 1994 by the inventor of the present application, discloses a network coupling device using dual-cables to connect two personal computers to a computer network system.

SUMMARY OF THE INVENTION

The present invention provides a new structure for a distributor which can be connected to personal computers by regular BNC plug cables. When a personal computer is properly connected to the distributor, computer network signals are distributed to the personal computer. If the personal computer is not properly connected to the distributor, the distributor provides an auto by-pass function to send computer network signals back to the computer network system. To achieve this function, the auto by-pass distributor comprises a first signal terminal, which receives a computer network signal, a second signal terminal, which sends computer network signal back to the computer network system, a first metal contact plate disposed in contact with the first signal terminal, a second metal contact plate disposed in contact with the second signal terminal, a first conductor connected between the first signal terminal and the second metal contact plate, and a second conductor connected between the second signal terminal and the first metal contact plate, and in which the first signal terminal or the second signal terminal is disconnected from the first metal contact plate or the second metal contact plate when only the first coaxial cable connector or only the second coaxial cable connector is connected to the personal computer, allowing a computer network signal to be returned to the computer network system.

DETAILED DESCRIPTION OF THE PREFERRED EMBODIMENT

Figure 1:
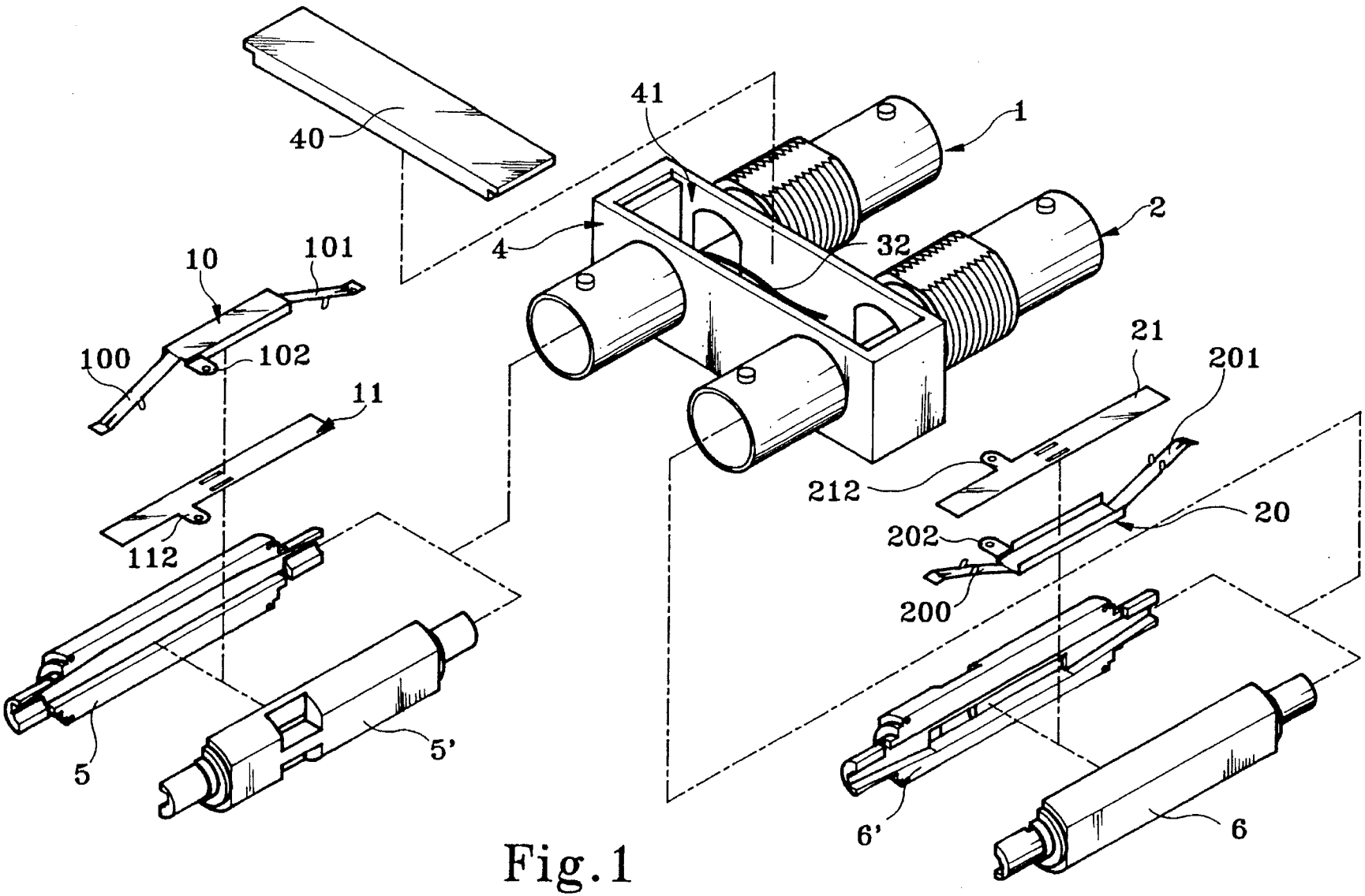
FIG. 1 is an exploded view of an auto by-pass distributor according to the present invention.
Figure 2:
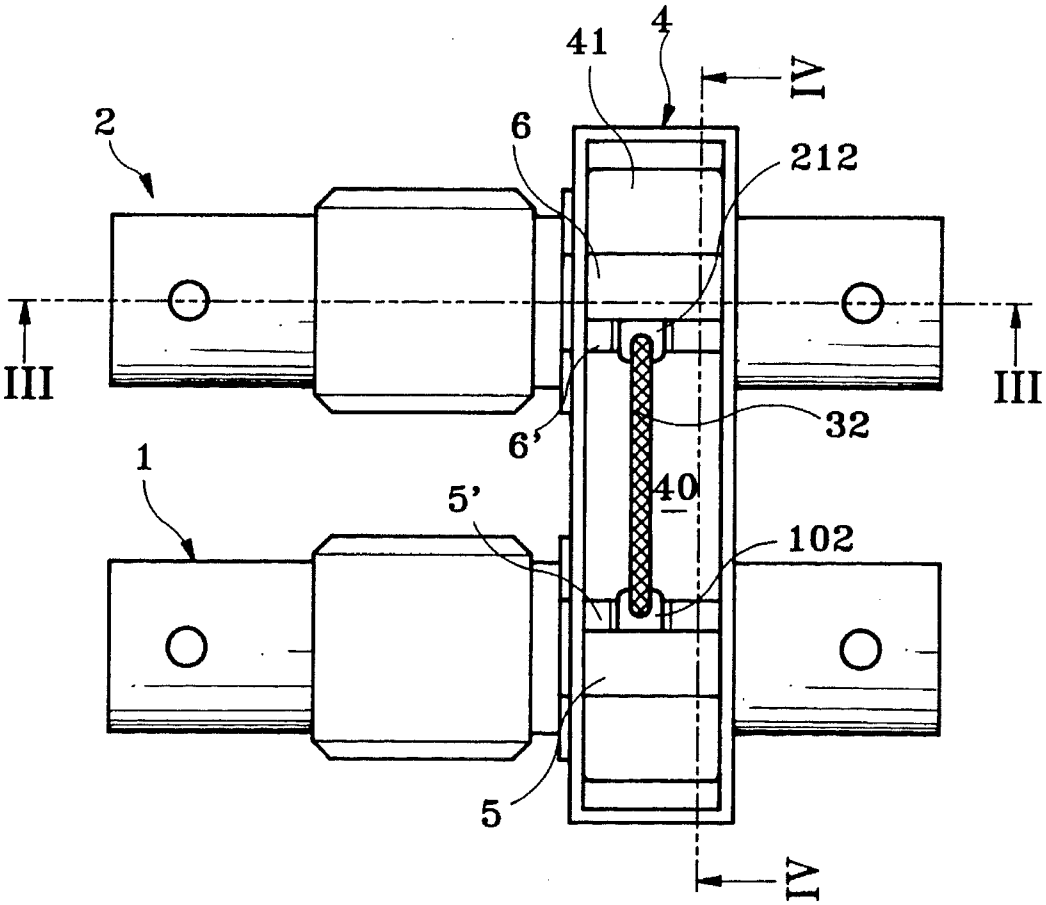
FIG. 2 is a plan view of the auto by-pass distributor shown in FIG. 1.

Referring to FIGS. 1 and 2, an auto by-pass distributor in accordance with the preferred embodiment of the present invention is generally made up of a first coaxial cable connector 1 and a second coaxial cable connector 2. computer network signals are transmitted to the first coaxial cable connector 1 for distribution to the personal computers, which are connected to the opposite end of the first coaxial cable connector 1, and then returned to the computer network system through the second coaxial cable connector 2. A first signal terminal 10 and a second signal terminal 20 are respectively mounted inside the first coaxial cable connector 1 and the second coaxial cable connector 2, so that the first signals terminal 10 receives computer network signal from the computer network system and the second signal terminal 20 returns computer network signals to the computer network system. The signal terminal 10 or 20 has a front contact portion 100 or 200 at one end constantly maintained in contact with the network cable (see FIG. 5A), causing the distributor to be connected in series to the computer network system, and a rear contact portion 101 or 201 at an opposite end. The rear contact portion 101 or 201 is disposed in contact with a respective contact metal plate, namely, the first metal contact plate 11 or the second metal contact plate 21 (see FIG. 5A) when the coaxial cable connector 1 or 2 is not connected to any personal computer. However, when a personal computer is connected to the coaxial cable connector 1 or 2, the rear contact portion 101 or 201 of the signal terminal 10 or 20 is disconnected from the contact metal plate 11 or 21, and therefore the computer network signals can be transmitted through the signal terminal 10 or 20 to the linked personal computer.

The first signal terminal 10 is connected to the second metal contact plate 21 by a first conductor 32, and the second signal terminal 20 is connected to the first metal contact plate 11 by a second conductor 31 to form a loop for allowing the computer network signals to be returned to the computer network system when the first coaxial cable connector 1 and the second coaxial cable connector 2 are not connected to any personal computer (see FIGS. from 5A to 5D).

Figures 5A, 5B, 5C, 5D:
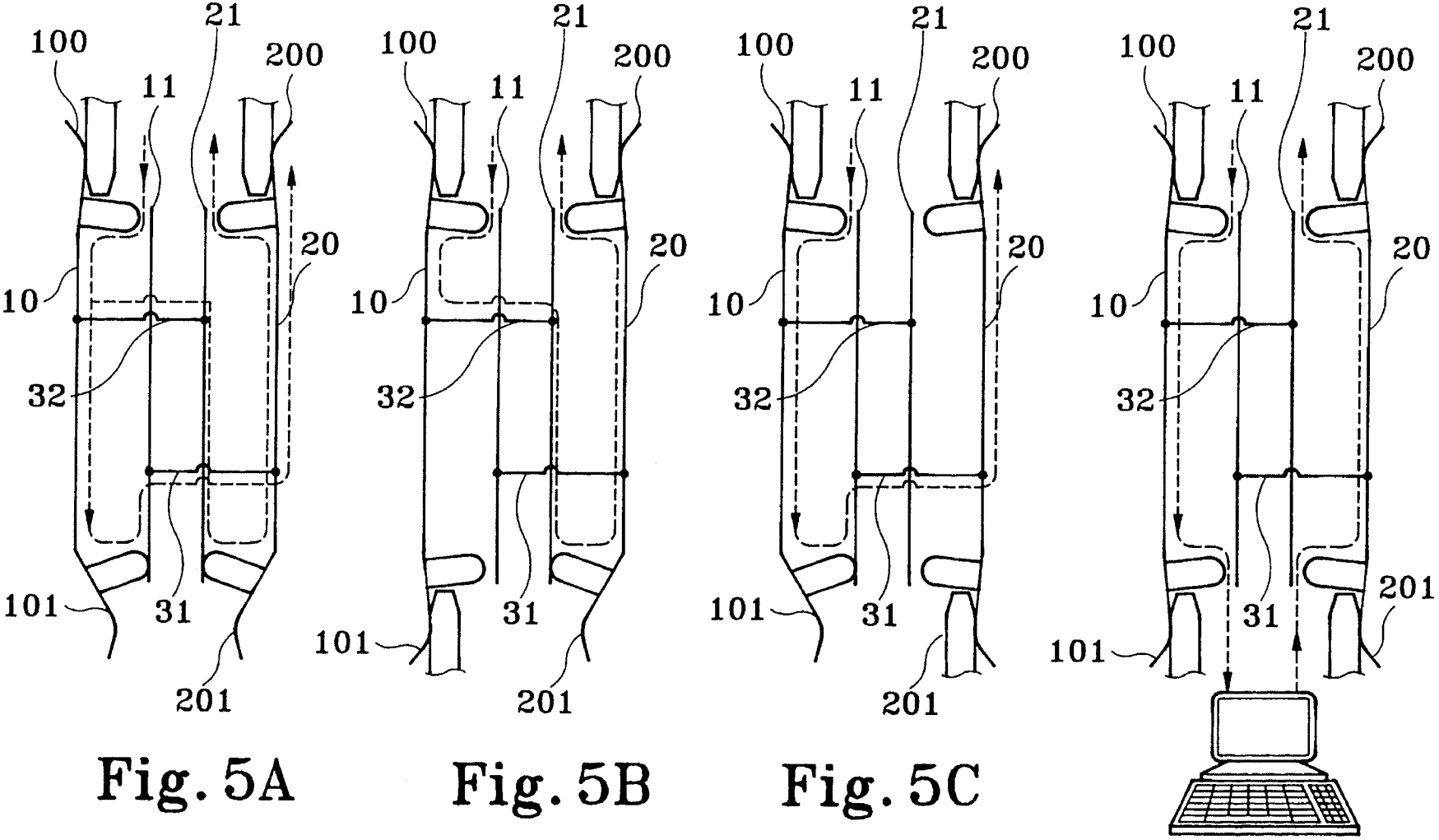
FIG. 5A shows the transmission of computer network signals through the auto by-pass distributor of the preferred embodiment of the present invention when no personal computer is connected to either coaxial cable connector.
FIG. 5B shows the transmission of computer network signals through the auto by-pass distributor of the preferred embodiment of the present invention when a personal computer is connected only to the first coaxial cable connector.
FIG. 5C shows the transmission of computer network signals through the auto by-pass distributor of the preferred embodiment of the present invention when a personal computer is connected only to the second coaxial cable connector.
FIG. 5D shows the transmission of computer network signals through the auto by-pass distributor of the preferred embodiment of the present invention when a personal computer accurately connected to the first coaxial cable connector and the second coaxial cable connector.

As illustrated in FIG. 5A, when the rear contact portions 101 and 201 are not connected to any personal computer, computer network signals are transmitted in proper order either through the first signal terminal 10, the first conductor 32, the second metal contact plate 21, the rear contact portion 201, and the second signal terminal 20, and then returned to the computer network system, or through the first signal terminal 10, the rear contact portion 101, the first metal contact plate 11, the second conductor 31, and the second signal terminal 20, and then returned to the computer network system.

Referring to FIG. 5B, when a personal computer is connected only to the first coaxial cable connector 1, the rear contact portion 101 is disconnected from the first metal contact plate 11. At this stage, computer network signals are prohibited from entering the personal computer and then returning to the second signal terminal 2, i.e., the computer network signals are not distributed to the personal computer by the auto by-pass distributor but transmitted in proper order through the first signal terminal 10, the first conductor 32, the second metal contact plate 21, the rear contact portion 201, and the second signal terminal 20, and then returned to the computer network system. Therefore, if a personal computer is not properly connected to the auto by-pass distributor, the auto by-pass distributor forms a loop with the computer network system to automatically send computer network signals back to the computer network system.

Referring to FIG. 5C, when a personal computer is connected only to the second coaxial cable connector 2, computer network signals are prohibited from entering the personal computer but are transmitted in proper order through the first signal terminal 10, the rear contact portion 101, the first metal contact plate 11, the second conductor 31, and the second signal terminal 20, and then returned to the computer network system.

Referring to FIG. 5D, when a personal computer is properly connected to the first coaxial cable connector 1 and the second coaxial cable connector 2, computer network signals are then transmitted in proper order through the first signal terminal 10 to the personal computer, then to the second signal terminal 20, and then returned to the computer network system.

Figure 3:
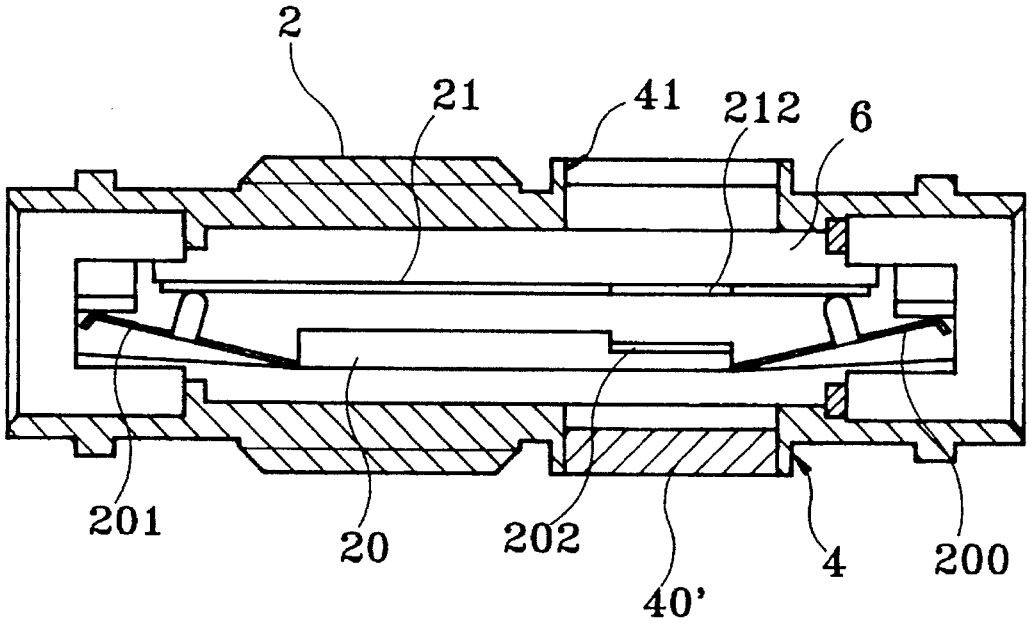
FIG. 3 is a sectional view taken along line AI—AI of FIG. 2, showing the positions of the first signal terminal and the first metal contact plate inside the first coaxial cable connector.
Figure 4:
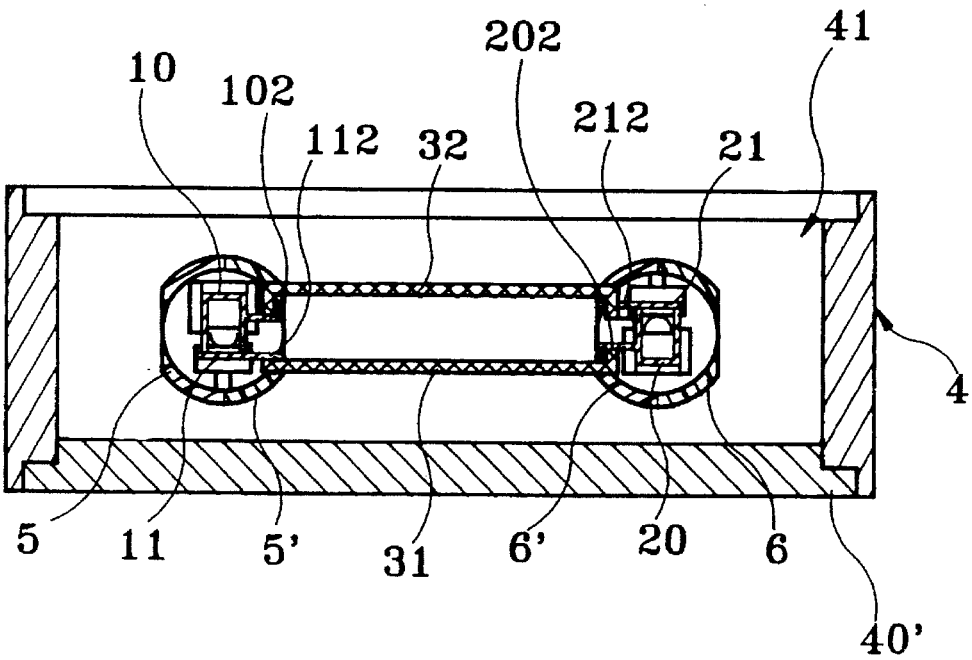
FIG. 4 is a sectional view taken along line III—III of FIG. 2, showing the connection between the first signal terminal and the second metal contact plate and the connection between the second signal terminal and the first metal contact plate.

Referring to FIGS. 2, 3, and 4, and FIG. 1 again, the first coaxial cable connector 1 and the second coaxial cable connector 2 are joined by a rectangular casing 40; the first signal terminal 10 and the first metal contact plate 11 are covered by insulative coverings 5 and 5'; the second signal terminal and the second metal contact plate 21 are covered by insulative coverings 6 and 6'; the first signal terminal 10, the first metal contact plate 11, the second signal terminal 20 and the second metal contact plate 21 have a respective projecting portion 102, 112, 202, or 212 extended out of the respective insulative covering 5, 5', 6, or 6' so that the first conductor 32 can be welded between the projecting portions 102 and 212 and the second conductor 31 can be welded between the projecting portions 112 and 202. Furthermore, the relative positions of the first metal contact plate 11 and the second signal terminal 20 as well as the relative positions of the second metal contact plate 21 and the first signal terminal 10 must be properly arranged, as shown in FIG. 4, so that the first conductor 32 and the second conductor 31 can be conveniently installed. When the first conductor 32 and the second conductor 31 are installed, a cover plate 40 is fastened to the casing 4 to seal its top opening 41.

I claim:

1. An auto by-pass distributor for distributing computer network signals to personal computers, comprising:

a first coaxial cable connector and a second coaxial cable connector;

a first signal terminal mounted within the first coaxial cable connector and having a front contact portion arranged to be connected to one of a coaxial cable of a computer network system and a personal computer and a rear contact portion arranged to be connected with the other of the coaxial computer network system and the personal computer;

a first metal contact plate arranged to be resiliently contacted by both of the rear and front contact portions of the first signal terminal and to disengage from the rear contact portion of the first signal terminal in response to connection of the rear contact portion of the first signal terminal to either the coaxial cable of the computer network or the personal computer, and to disengage from the front contact portion of the first signal terminal in response to connection of the front contact portion of the first signal terminal to either the coaxial cable of the computer network or the personal computer;

a second signal terminal mounted within the second coaxial cable connector and having a front contact portion arranged to be connected either to said one of the coaxial cable of the computer network system and to return computer network signals from said first signal terminal to the computer network system or to said personal computer, and a rear contact portion arranged to be connected to the other of the personal computer and the computer network system; and a second metal contact plate arranged to contact both of the rear and front contact portions of the second signal terminal and to disengage from the rear contact portion of the second signal terminal in response to connection of the rear contact portion of the second signal terminal to either the coaxial cable of the computer network or the personal computer, and to disengage from the front contact portion of the second signal terminal in response to connection or the front contact portion of the second signal terminal to either the coaxial cable of the computer network or the personal computer;

means for electrically connecting the first signal terminal to the second contact plate such that when either of the front and rear contact portions of the second signal terminal contacts the second contact plate because it is not connected to the coaxial cable of the computer network or to the personal computer, the first and second signal terminals are electrically connected to each other; and means for electrically connecting the second signal terminal to the first contact plate such that when either of the front and rear contact portions of the first signal terminal contacts the first contact plate because it is not connected to the coaxial cable of the computer network or to the personal computer, the first and second signal terminals are electrically connected to each other.

* * * * *